US005355624A

United States Patent [19]

Bacon

[11] Patent Number: 5,355,624

[45] Date of Patent: Oct. 18, 1994

[54] MODULAR, POWERED CLOSURE APPARATUS

[76] Inventor: Russell E. Bacon, 5201 Summerhill Rd., Apt. 506, Texarkana, Tex. 75503

[21] Appl. No.: 992,796

[22] Filed: Dec. 18, 1992

[51] Int. Cl.[5] ..... E05F 15/00

[52] U.S. Cl. ..... 49/280; 49/362

[58] Field of Search ..... 49/280, 360, 139, 449, 49/362

[56] References Cited

U.S. PATENT DOCUMENTS

| | | | |
|---|---|---|---|
| 1,063,328 | 6/1913 | Christopher | 49/362 X |
| 1,647,901 | 11/1927 | Carver | 49/362 |
| 1,997,175 | 4/1935 | Gussack | 49/280 X |
| 3,744,827 | 7/1973 | Cox | 49/409 X |
| 4,612,729 | 9/1986 | Sato | 49/280 X |
| 4,887,205 | 12/1989 | Chou | 49/280 X |
| 5,146,712 | 9/1992 | Hlavaty | 49/360 X |

*Primary Examiner*—Peter M. Cuomo
*Assistant Examiner*—Jerry Redman
*Attorney, Agent, or Firm*—Thomas R. Lampe

[57] ABSTRACT

Modular, powered closure apparatus for installation as a unit into an opening of a building. The apparatus includes a rigid framework to be secured to the building and closure panels, one of which is affixed to the framework and the other of which is slidable in the framework. The framework includes a housing which accommodates an electric motor and transmission means extending between the motor and second closure panel to selectively move the second closure panel between open and closed positions.

12 Claims, 3 Drawing Sheets

MODULAR, POWERED CLOSURE APPARATUS

TECHNICAL FIELD

This invention relates to a modular, powered closure apparatus for installation as a unit into an opening of a building. The form of the apparatus disclosed herein is a modular, powered window; however, the principles of the invention are applicable to other closures associated with buildings, principally doors.

BACKGROUND ART

It is known in the prior art to provide for movement of window and door panels by prime movers, including electric motors. Many such arrangements are unwieldy and complicated, rendering them awkward and difficult with regard to both installation and use. A search of the prior art located the following patents which are believed to be representative of the state of the prior art: U.S. Pat. No. 2,684,239, issued Jul. 20, 1954, U.S. Pat. No. 3,403,474, issued Oct. 1, 1968, U.S. Pat. No. 1,952,821, issued Mar. 27, 1934, U.S. Pat. No. 3,344,556, issued Oct. 3, 1967, U.S. Pat. No. 3,890,744, issued Jun. 24, 1975, U.S. Pat. No. 4,858,383, issued Aug. 22, 1989, U.S. Pat. No. 4,541,202, issued Sep. 17, 1985, and U.S. Pat. No. 4,893,435, issued Jan. 16, 1990.

DISCLOSURE OF INVENTION

The present invention relates to modular, powered closure apparatus which is particularly adapted for installation as a unit into an opening of a building. The particular embodiment of the invention disclosed herein is a powered window and the apparatus is so constructed as to facilitate its ready placement into a building window opening as a unitary entity. Many of the prior art arrangements relating to powered windows do not at all lend themselves to installation as a unitary module. Furthermore, some prior art devices must be retrofit to existing windows and are essentially independent from the frame structure of the window. This means that installation is difficult and the resultant structure is often comparatively unsightly in appearance.

By contrast, the apparatus of the present invention is in the form of a module which may be installed in much the same way that a conventional window is installed. This means that the installer need have no special skills over and above that of the competent carpenter. The structural elements which are employed to open and close a movable window panel is housed within a housing which comprises at least a portion of either the top or bottom framework element of the apparatus. This not only provides a pleasing aesthetic appearance but results in a strengthening and stabilizing of the structure as a whole.

The modular, powered closure apparatus of the present invention is for installation as a unit into an opening of a building. The apparatus includes a rigid framework to be secured to the building in the opening and defining a framework interior.

The framework includes a top framework element for engagement with the building, a bottom framework element for engagement with the building, and side framework elements for engagement with the building and interconnecting the top and bottom framework elements. At least one of the top and bottom framework elements includes a housing extending between the side framework elements, the housing having a housing interior.

A first closure panel is fixed in position on the framework between the top and bottom framework elements and extends into the framework interior from a side framework element.

A second closure panel is positioned on the framework within the framework interior and movable relative thereto and relative to the first closure panel between an open position and a closed position.

An electric motor is mounted in the housing interior and a switch is operatively associated with the electric motor for selectively energizing and de-energizing the electric motor.

The apparatus additionally includes support means for supporting the second closure panel during movement of the second closure panel between the open and closed positions. Transmission means operatively connects the electric motor and the second closure panel to selectively move the second closure panel between the open and closed positions upon energization of the electric motor.

As disclosed herein, the transmission means includes an elongated rack affixed to the second closure panel movable relative to the housing and a pinion interconnected with the rack and rotatable by the electric motor to move the rack. The pinion and at least a portion of the rack are disposed in the housing interior.

The apparatus further includes lock means responsive to the de-energization of the electric motor to lock the second closure panel against movement relative to the framework. The lock means includes an electrical solenoid having an armature movable between a lock position wherein the armature engages the rack to prevent movement of the rack and an unlock position wherein the armature is disengaged from the rack and allows movement of the rack. The solenoid is operatively associated with the electric motor and electrically energized upon energization of the electric motor to disengage the armature from the rack.

Biasing means is employed to continually bias the armature toward the rack and manually movable means projecting from the housing and connected to the armature is provided for manually withdrawing the armature from a hole in the rack against the bias exerted by the biasing means.

Other features, advantages, and objects of the present invention will become apparent with reference to the following description and accompanying drawings.

MODES FOR CARRYING OUT THE INVENTION

Figure 1:
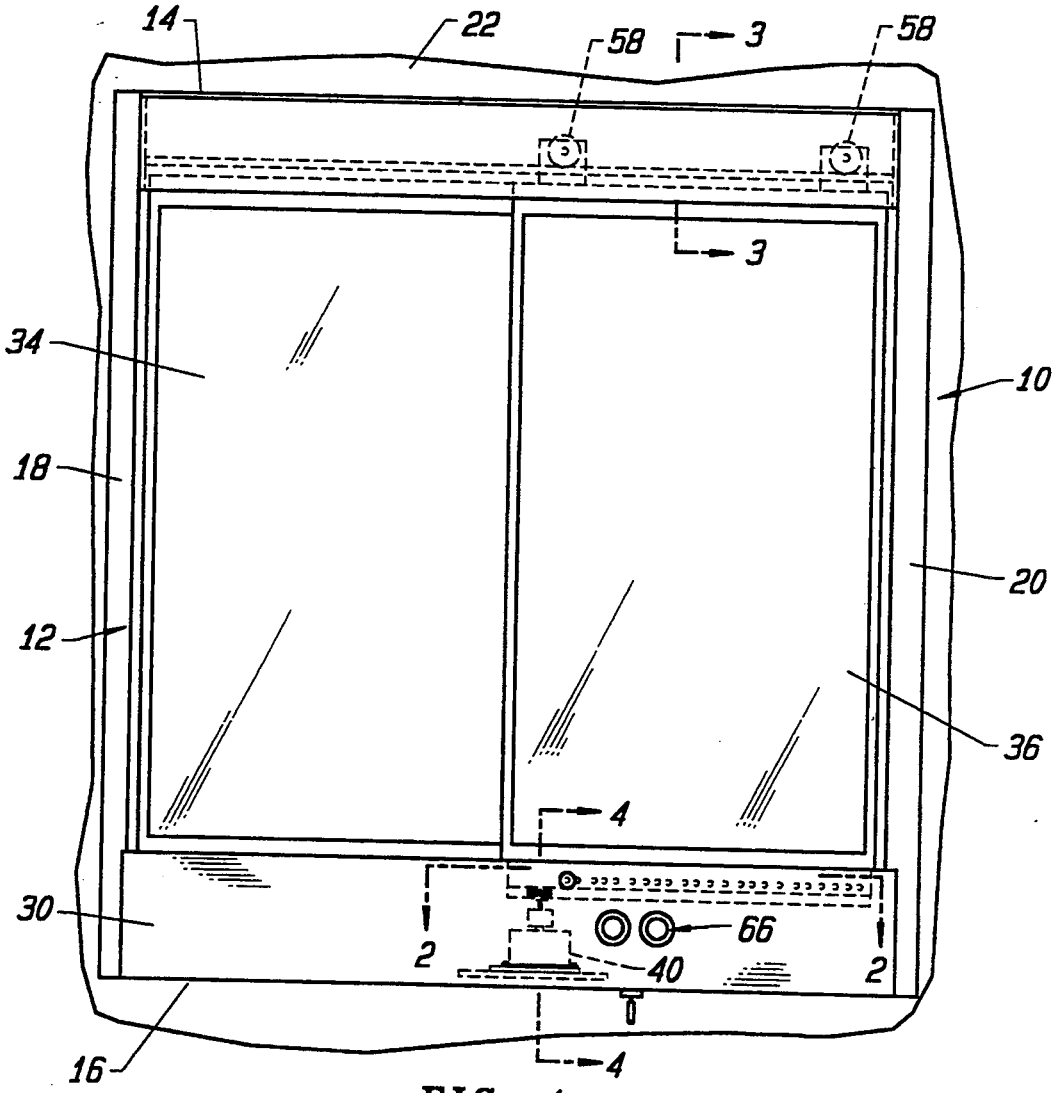
FIG. 1 is a frontal view of a modular, powered window constructed in accordance with the teachings of the present invention installed in a building wall.
Figure 2:
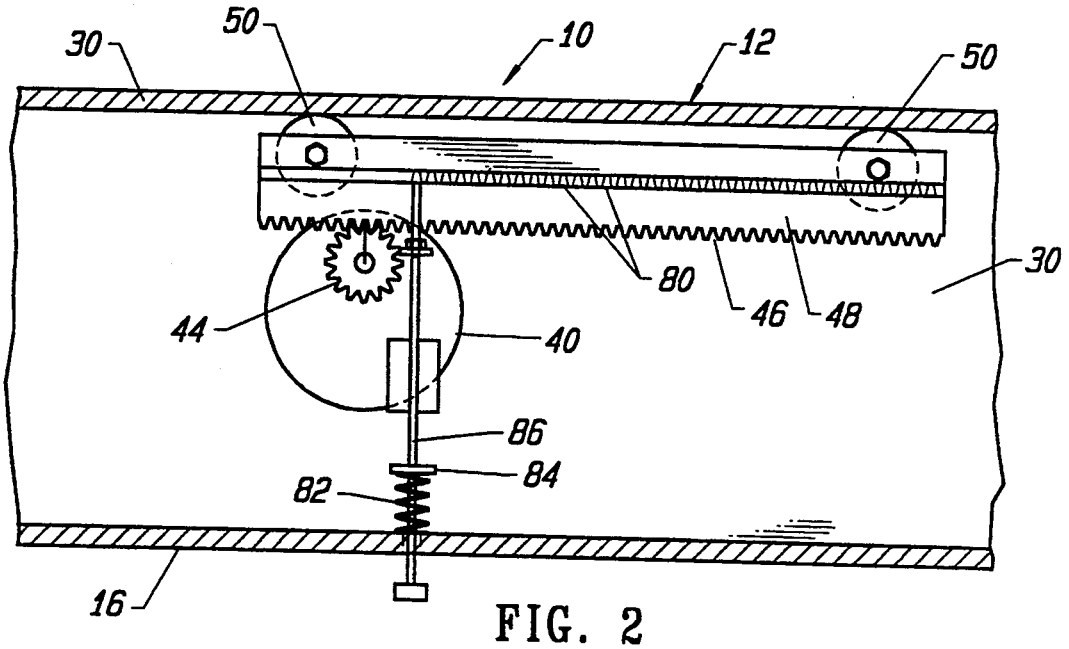
FIG. 2 is an enlarged, cross-sectional fragmentary view taken along the line 2—2 in FIG. 1.

Referring now to FIGS. 1 through 5, apparatus constructed in accordance with the teachings of the present invention is generally designated by reference numeral 10. More particularly, apparatus 10 is a modular, powered window. Apparatus or window 10 includes a rigid framework 12 constructed of steel, aluminum or other suitable material. Framework 12 includes a top framework element 14, bottom framework element 16 and side framework elements 18, 20 interconnecting the top and bottom framework elements.

Figure 3:
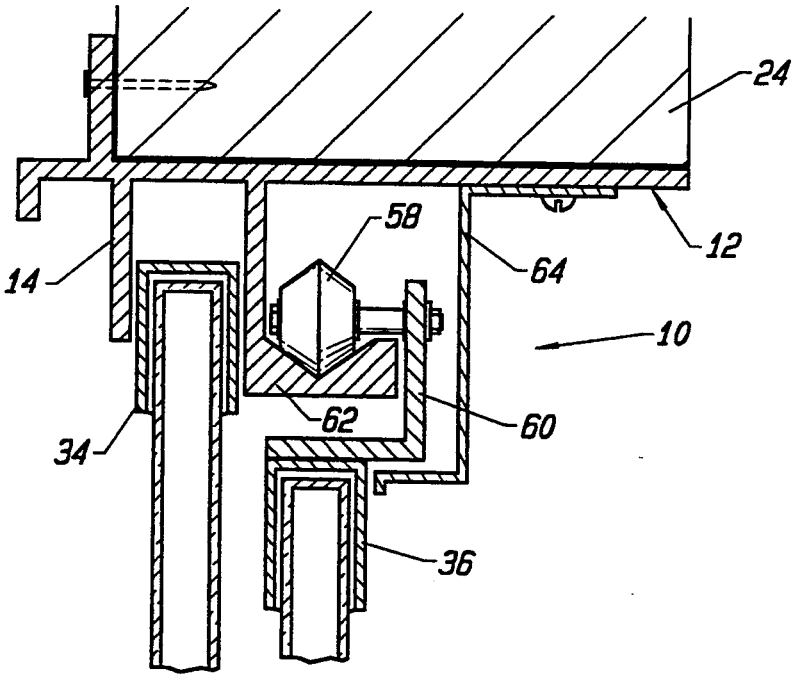
FIG. 3 is an enlarged, fragmentary cross-sectional view taken along the line 3—3 in FIG. 1.
Figure 4:
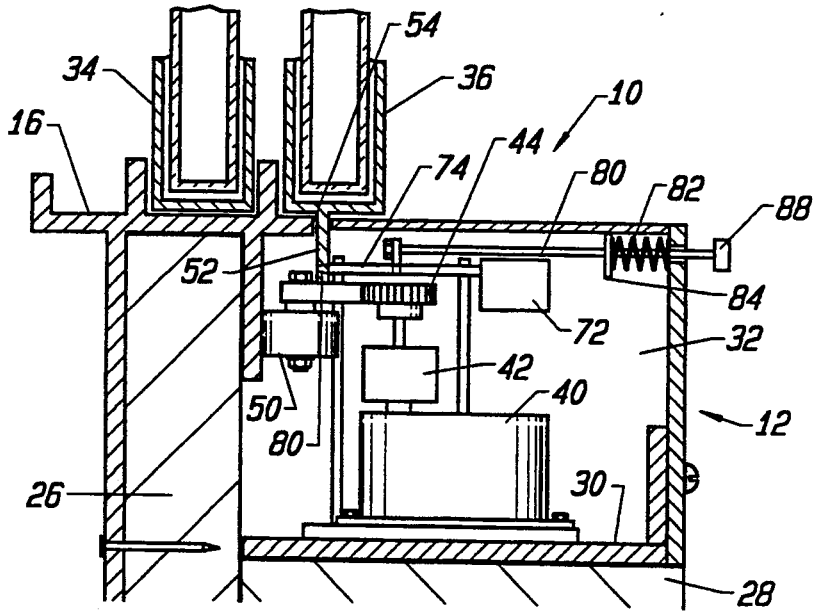
FIG. 4 is an enlarged, fragmentary cross-sectional view taken along the line 4—4 in FIG. 1.

All of the framework elements are engageable with the building wall 22 which defines an opening into which the modular, powered window is installed as a unit. FIG. 3 shows a wood header 24 to which top framework element 14 is nailed in the same manner one would install a conventional window frame. FIG. 4 shows a stud 26 and header 28 to which the bottom framework element 16 is secured in like fashion, the nails not being shown in this instance.

Bottom framework element 16 includes a housing 30 which extends the entire distance between side framework elements 18, 20 and defines an interior 32.

A first window panel 34 is fixed in position on the framework between the top and bottom framework elements and extends into the framework interior from side framework element 18.

A second window panel 36 is positioned on the framework within the framework interior and movable relative thereto and relative to the first window panel 34 between an open position and a closed position. In FIG. 1, second window panel 36 is illustrated in its closed position and it will be appreciated that its open position is the position assumed by second window panel 36 when it moves to the left in the manner of a conventional double panel window.

Positioned within interior 32 of housing 30 is an electric motor 40 having an output shaft connected to a transmission including torque switch 42. The output shaft of the transmission including torque switch 42 has a pinion 44 secured thereto.

The teeth of pinion 44 engage teeth 46 of an elongated rack member 48 which is mounted for endwise movement within the housing interior on support rollers 50 and upstanding leg 52 of the rack projects upwardly and outwardly through an elongated slot 54 defined by the housing at the upper end thereof. Leg 52 is integral with the metal border of second window panel 36 as may perhaps best be seen with reference to FIG. 4. Thus, endwise movement of the rack 48 will cause corresponding movement of the second window panel. This means, of course, that movement of the second window panel will be effected by energization of motor 40.

With particular reference to FIGS. 1 and 3, it will be seen that the top end of second window panel 36 is disposed under rollers 58 rotatably journaled in a bracket 60 secured to the top of the second window panel as by welding or the like. Rollers 58 rotate as the second window panel 36 is moved by the motor and traverses along a track 62 comprising part of top framework element 14. A shield plate 64 is connected to the top framework element 14 by screws or other suitable fastener means and extends between the side framework elements. The shield plate covers and protects the roller, track, and related structure. This is not only a safety feature but one which improves the appearance of the apparatus.

Actuation or energization of motor 40, which is a reversible motor, is accomplished by a switch 66 (FIG. 5) which may be moved between a position which opens the window by moving the second window panel to its open position or a position which closes the window through an intermediate position wherein the motor is not energized. Lights 68, 70 may be employed in the circuit to indicate to the operator whether the window is being opening or closed.

Also disposed within the interior of housing 30 is an electrical solenoid 72 having an armature 74 movable between an extended position (the position shown in FIG. 4) and a retracted position. In its extended position the distal end of the armature enters one of a plurality of spaced holes 80 which are formed along the length of rack 48. The holes are, of course, brought into sequential registry with the armature (assuming the armature is in its retracted condition) during movement of the rack. The entry of the armature distal end into a hole will lock the rack, and second window panel 36, against slidable movement.

A coil spring 82 continuously bears against an enlargement 84 on a shaft 86 mounted for axial movement within the housing. The interior end of the shaft 86 is secured in any desired fashion to the armature 74 so that the shaft and armature are jointly moved axially. That is, linear movement of the shaft will result in linear movement of the armature and vice versa. The coil spring 82 is always under compression between enlargement 84 and the front housing wall so that the shaft and armature are continuously urged to the left as viewed in FIG. 4. A knob 88 is secured to the outer end of the shaft so that the shaft and armature may be manually moved to the right as viewed in FIG. 4 upon application of force sufficient to overcome the bias of spring 82. In other words, the armature is always biased toward its lock position by the spring but may be moved to its unlock position by an opposed force sufficient to overcome the spring bias.

Figure 5:
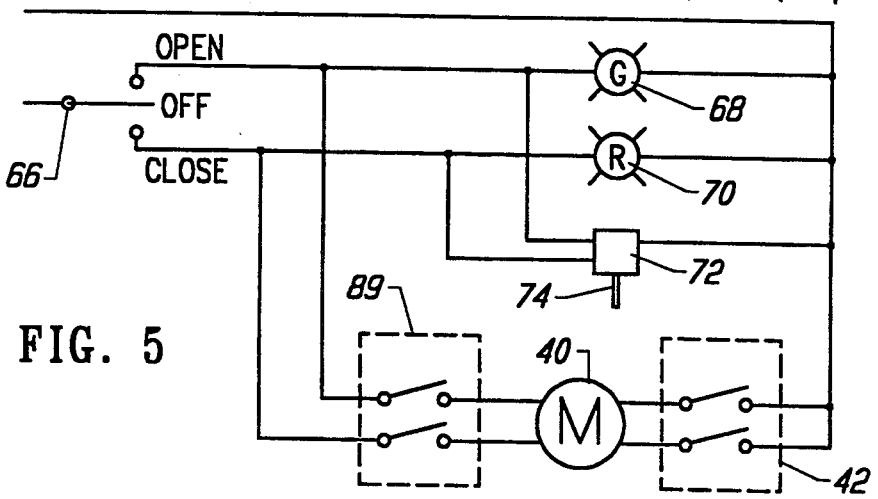
FIG. 5 is an electrical diagram of the electrical circuit employed when practicing the teachings of the present invention.

As shown in the circuit diagram of FIG. 5, the solenoid 72 is operatively associated with the switch 66 and motor 40 so that energization of motor 40 also results in energization or actuation of solenoid 72. This will disengage the armature 74 from the rack and allow the rack and associated second window panel 36 to slide under the influence of the motor. It is highly desirable to provide a slight time delay between energization of the motor and of the solenoid and this is accomplished by a delay relay 89 in the circuit. If some delay did not exist between energization of the motor and the solenoid, jamming of the armature in the rack could possibly occur. It is, of course, to be understood that the force exerted by the energized solenoid on the armature will be sufficient to overcome the resistance of coil spring 82 and allow movement of the armature away from the rack.

The holes 80 are preferably defined by a tapered surface, as shown, to guide the armature into the holes. Furthermore, it is preferred that the distal or outer end of the armature be pointed to facilitate entry of the armature distal end into the holes.

Figure 6:
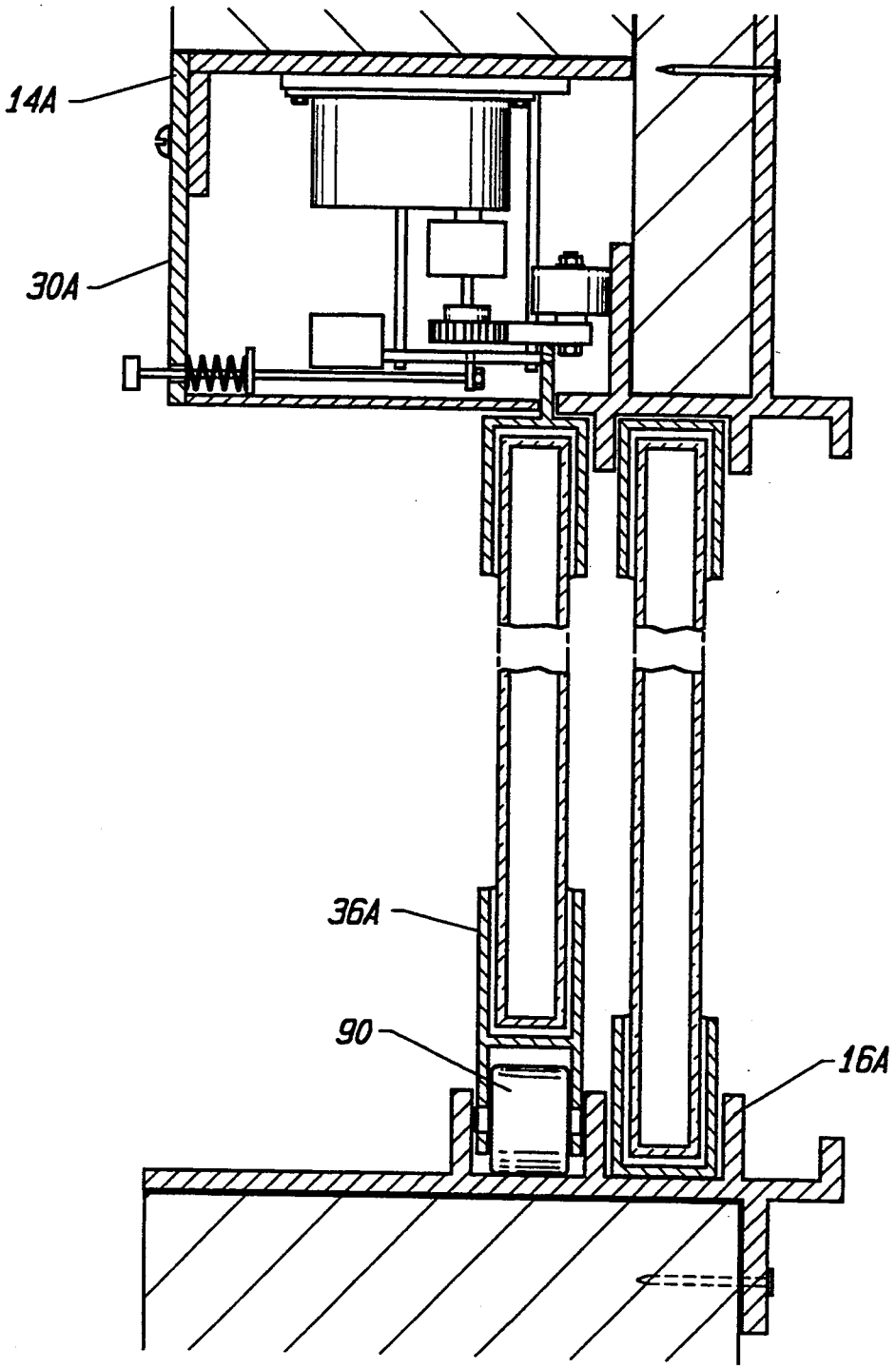
FIG. 6 is a cross-sectional view of a portion of an alternative embodiment of the present invention.

FIG. 6 shows an alternative embodiment of the invention which is quite similar to the embodiment just described. In this instance, however, the housing 30A is included in the top framework element 14A. Thus, the movable window panel 36A is disposed below the housing and the mechanism housed therein. Such mechanism is the same as that previously described with reference to the first embodiment of the invention.

Second window panel 36A is not supported at the top thereof, but rather at the bottom thereof by rollers 90 (only one of which is shown) rotatably mounted at the bottom of the second window panel and traversing a track 92 defined by bottom framework element 16A.

Transmission with torque switch 42 is a safety feature since it will allow window panel movement to be halted by de-energizing the motor when a predetermined level of resistance to such movement is reached, for example, when the window bears against a portion of a person's body. The transmission with torque switch 42 also will de-energize the motor when the window fully opens or closes due to the resistance to movement encountered

I claim:

1. Modular, powered closure apparatus for installation as a unit into an opening of a building, said apparatus comprising, in combination:

a rigid framework to be secured to the building in said opening and defining a framework interior, said framework including a top framework element for engagement with the building, a bottom framework element for engagement with the building, and side framework elements for engagement with the building interconnecting said top and bottom framework elements, at least one of said top and bottom framework elements including a housing extending between said side framework elements having a housing interior;

a first closure panel fixed in position on said framework between said top and bottom framework elements and extending into the framework interior from a side framework element;

a second closure panel positioned on said framework within said framework interior and movable relative thereto and relative to said first closure panel between an open position and a closed position;

an electric motor mounted in said housing interior;

a switch operatively associated with said electric motor for selectively energizing and de-energizing said electric motor;

support means for supporting said second closure panel during movement of said second closure panel between said open and closed positions;

transmission means operatively connecting said electric motor and said second closure panel to selectively move said second closure panel between said open and closed positions upon energization of said electric motor, said transmission means including an elongated rack affixed to said second closure panel movable relative to said housing and a pinion interconnected with said rack and rotatable by said electric motor to move said rack, said pinion and at least a portion of said rack being disposed in said housing interior;

lock means responsive to de-energization of said electric motor to lock said second closure panel against movement relative to said framework, Said lock means including an electrical solenoid having an armature movable between a lock position wherein said armature engages said rack to prevent movement of said rack and an unlock position wherein said armature is disengaged from said rack and allows movement of said rack, said solenoid being operatively associated with said electric motor and electrically energized upon energization of said electric motor to disengage said armature from said rack; and biasing means continuously biasing said armature toward said rack, said rack defining a plurality of spaced holes along the length of said rack, said holes being brought into sequential registry with said armature during movement of said rack, and said armature entering the hole in registry therewith upon de-energization of said electric motor due to the bias of said biasing means.

2. The apparatus according to claim 1 wherein said housing defines a slot communicating with said housing interior, said rack extending through said slot and affixed to said second closure panel.

3. The apparatus according to claim 1 additionally comprising manually movable means projecting from said housing and connected to said armature for manually withdrawing the armature from a hole in said rack against the bias exerted by said biasing means.

4. The apparatus according to claim 1 additionally comprising delay relay means in operative association with said electric motor and said solenoid to delay energization of said electric motor until said solenoid has been energized to disengage the armature from said rack.

5. The apparatus according to claim 1 wherein said electric motor is a reversible motor, said apparatus including signal means operatively associated with said electric motor to signal whether said second closure panel is moving toward said open position or toward said closed position upon energization of said electric motor.

6. The apparatus according to claim 1 wherein said top framework element includes said housing, said support means comprising bottom roller means rotatably mounted at the bottom of said second closure panel and bottom track means defined by said bottom framework element accommodating said bottom roller means and defining the path of movement of said bottom roller means.

7. The apparatus according to claim 1 wherein said bottom framework element includes said housing, said support means comprising top roller means rotatably mounted at the top of said second closure panel and top track means defined by said top framework element accommodating said top roller means and defining the path of movement of said top roller means.

8. The apparatus according to claim 7 additionally comprising a shield plate connected to said top framework element and extending substantially between said side framework elements, said shield plate covering said top roller means and top track means.

9. The apparatus according to claim 1 wherein said holes are at least partially defined by a tapered surface engageable by a distal end of said armature to guide said armature into said holes.

10. The apparatus according to claim 9 wherein the distal end of said armature is pointed to facilitate entry of said armature distal end into said holes.

11. The apparatus according to claim 1 wherein said first and second closure panels are window panels.

12. Modular, electrically powered window apparatus for installation as a unit into an opening of a building of predetermined size defined by building window frame elements including a top header element and a bottom header element, said apparatus comprising, in combination:

a rigid, unitary window framework to be secured to the building in said opening and defining a window framework interior, said rigid, unitary window framework including a top framework element for engagement with the building and securement to said top header element, a bottom framework element for engagement with the building and securement to said bottom header element, and side framework elements for engagement with the building interconnecting said top and bottom framework elements, at least one of said top and bottom framework elements including a housing having a face plate extending between said side framework elements and defining a housing interior, and said rigid, unitary window framework having an outer periphery substantially corresponding in size and shape to the size and shape of said opening whereby said rigid, unitary window framework including said housing is received in said opening and surrounded by said top, bottom and side framework elements when the rigid unitary window framework is secured to the building;

a first window panel fixed in position within said rigid, unitary window framework between said top and bottom framework elements and extending into the window framework interior from a side framework element;

a second window panel positioned within said rigid, unitary window framework within said framework interior and movable relative to said rigid, unitary window framework and relative to said first window panel between an open position and a closed position;

a reversible electric motor mounted in said housing interior;

a switch operatively associated with said electric motor for selectively energizing and de-energizing said electric motor;

support means connected to said rigid, unitary window framework and encompassed by said rigid, unitary window framework for supporting said second window panel during movement of said second window panel between said open and closed positions, said rigid, unitary window framework defining a track and said support means including roller means connected to said second window panel and movable in said track; and transmission means mounted in said housing interior operatively connecting said electric motor and said second window panel to selectively move said second window panel between said open and closed positions upon energization of said electric motor, said transmission means including a transmission element connected to said second window panel movable relative to said housing and a rotatable member interconnected with said transmission element and rotatable by said electric motor to move said transmission element, said housing defining a housing opening communicating with said housing interior, and said transmission element and said second window panel being interconnected through said housing opening.

* * * * *